US005493967A

United States Patent [19]

Malin et al.

[11] Patent Number: 5,493,967

[45] Date of Patent: Feb. 27, 1996

[54] VALUE SELECTION AND PRINTING APPARATUS INCLUDING A SECURITY DEVICE

[75] Inventors: Richard A. Malin, Westport, Conn.; Christopher M. Giles, London; Brian R. O'Neale, Essex, both of England; Stephen J. Rigo, Stamford, Conn.

[73] Assignee: Pitney Bowes Inc., Stamford, Conn.

[21] Appl. No.: 308,044

[22] Filed: Sep. 16, 1994

[51] Int. Cl.[6] ..... B41J 1/60

[52] U.S. Cl. ..... 101/91; 101/93.18; 101/99; 101/109

[58] Field of Search ..... 101/91, 109, 110, 101/93.12, 93.18, 93.47, 99; 400/70, 74, 104

[56] References Cited

U.S. PATENT DOCUMENTS

| | | | |
|---|---|---|---|
| 3,682,378 | 8/1972 | Rouan et al. | 235/101 |
| 4,050,374 | 9/1977 | Check, Jr. et al. | 101/91 |
| 4,630,210 | 12/1986 | Salazar et al. | 364/464 |
| 4,649,814 | 3/1987 | Sette | 101/110 |
| 4,858,525 | 8/1989 | Hubbard et al. | 101/91 |
| 5,050,495 | 9/1991 | Wu | 101/91 |
| 5,295,433 | 3/1994 | Malin | 101/91 |

*Primary Examiner*—Edgar S. Burr
*Assistant Examiner*—John S. Hilten
*Attorney, Agent, or Firm*—Steven J. Shapiro; David E. Pitchenik; Melvin J. Scolnick

[57] ABSTRACT

A value selection and printing apparatus includes a printing device having a printing wheel which is rotatable into a plurality of positions to present a corresponding plurality of value printing elements into a printing position; a value selecting device including a moveable first rack gear having a driven element thereon, a rigid guide shaft mounted within the printing device, a second rack gear mounted to be slidable on the guide shaft and having a driving element thereon in engagement with the driven element, wherein the second rack gear operatively engages the printing wheel so that rotation of the printing wheel occurs due to transmission of a moment of the first rack gear to the printing wheel via the second rack gear; and a substantially cylindrical security sleeve slidably disposed on the guide shaft and moveable in response to sliding movement of the second rack gear on the guide shaft wherein the guide shaft includes a weakened section such that at times when a force sufficient to disassociate the printing wheel and the second rack gear is exerted against the printing wheel, the guide shaft bends at the weakened section preventing sliding movement of the security sleeve over the weakened section.

15 Claims, 2 Drawing Sheets

VALUE SELECTION AND PRINTING APPARATUS INCLUDING A SECURITY DEVICE

BACKGROUND

1. Field of the Invention

This invention relates to a value selection mechanism, and more particularly to a postage value selection mechanism including a security device for preventing the printing of postage without payment being made.

2. Description of the Related Art

U.S. Pat. No. 4,050,374 for a METER SETTING MECHANISM, issued Sep. 27, 1977 to Check, Jr. and assigned to the assignee of the present invention and incorporated by reference herein, discloses a mechanism for selecting postage values which are to be printed by a rotary postage meter. The drive shaft of the drum includes a plurality of selectable racks, each of which is slidably movable in engagement with a different pinion gear, connected to an associated print wheel within the drum for selectively rotating the print wheel to dispose a, printing element or font thereof at the outer periphery of the drum for printing purposes. The value selection mechanism includes a first stepper motor which is operable for selecting one of the racks, and a second stepper motor which is operable for actuating the selected rack for selectively rotating the desired printing element of the associated print wheel to the printing position thereof. An electronic control system (not shown) which is coupled to a keyboard for processing postage value entries made by an operator, selectively drives the respective stepper motors in response to keyboard entries.

U.S. Pat. No. 4,630,210 for a MICROPROCESSOR CONTROLLED D.C. MOTOR FOR CONTROLLING A LOAD, issued Dec. 16, 1986 to Salazar, et al., and assigned to the assignee of the present invention and incorporated by reference herein, shows a conventional postage meter including a plurality of lengthwise translatable racks mounted n channels formed in the drive shaft of a rotatable postage printing drum. The drum includes a plurality of print wheels, which are mounted for rotation in the drum, and a like number of pinion gears connected on a one-for-one-basis with an associated print wheel. Each of the pinion gears is disposed, on a one for one basis, in meshing engagement with each of the rack gears, so that lengthwise translation of a rack gear results in rotation of the associated print wheel to a selected position thereof wherein a printing font at the periphery of the print wheel is located for printing purposes when the drum is rotated.

U.S. Pat. No. 4,649,814, for a ROTARY SELECTOR DEVICE, issued Mar. 17, 1987 to Sette and assigned to the assignee of the present invention and incorporated by reference herein, shows a rotary value selection mechanism, of the type used for selecting and driving the respective translatable racks of the aforesaid U.S. Pat. No. 4,630,210, including a first annularly-shaped rack selection member having a pinion gear mounted therewithin and movable therewith for selectively engaging the racks as the first member is rotated, and including a second annularly-shaped printwheel font selection member which is disposed in meshing engagement with the pinion gear teeth for translating the selected rack to move the associated print wheel as the second member is rotated.

U.S. Pat. No. 3,682,378 for VALUE DISPENSING MECHANISMS, issued Aug. 8, 1972 to Rouan, et al. and assigned to the assignee of the present invention and incorporated herein by reference, shows a value selection mechanism whereby the plurality of print wheels are movable via a mechanical gear/lever arrangement.

Value selection mechanisms of the aforesaid types have from time-to-time become physically damaged such that one or more rack gears have become disassociated from its associated print wheel driving gear, with the result that the print wheels may be rotated independently thereof. Whereupon, a postage value can be printed which is different from that which has been selected by the associated, translating, rack gear. Although the occurrence of such physical damage is immediately apparent to a postage meter user, meters have been known to be continued to be used despite such a malfunction condition, in order to wrongfully print postage values without a payment being made therefor. Of course, since postage meters are required to be physically inspected on a semi-annual basis, and more frequently when Postal Service inspectors through internal postage indicia inspection controls and accounting practices suspect that a postage meter is dispensing more postage than has currently been paid for, such physical damage has a short life span due to its inevitably early discovery. Nevertheless, any postage payment losses are rightfully of great concern to the Postal Service and to postage meter manufacturers. As a result, a series of experimental activities with postage meters have been conducted to determine the basic cause, if any, of disassociation of postage selecting racks and print wheels. And, it has been experimentally determined that the majority of instances in which such disassociations occur are due to a sufficient force being exerted against the print wheel to separate the same from the drive train therefor. Such a force could, for example, occur if someone tried to force movement of the printwheel in an attempt to print postage values without a payment being paid therefrom.

U.S. Pat. No. 5,295,433 for A VALUE SELECTION MECHANISM INCLUDING MEANS FOR WEAKENING A SHAFT THEREOF, issued Mar. 22, 1994 and assigned to the assignee of the present invention is incorporated by reference herein and discloses a device which solves, to some degree, the problems of the prior art discussed above. U.S. Pat. No. 5,295,433 shows a shaft mounted in a printhead drum and upon which a first gear rack is slidably mounted, via supporting elements, to a pinion gear associated with a print wheel. When the first gear rack is driven along the shaft due to interaction with a second gear rack, the pinion gear is forced into rotation thereby rotating the print wheel to position the selected printing element into a print position. The shaft upon which the first gear rack slides includes a circumferentially extending channel therein which acts as a weakened portion of the shaft. Thus, when a force tending to disassociate the print wheel from the first gear rack is applied to the print wheel, the shaft will permanently bend at the channel in response to the force. When bending occurs, the supporting elements of the first gear rack can no longer freely slide along the shaft, thereby jamming the value selection mechanism.

The apparatus of U.S. Pat. No. 5,295,433 is effective in Preventing the printing of postage values without the required postage payment accounting occurring. However, it is desirable to provide an improved security mechanism having increased sensitivity as compared to the apparatus of U.S. Pat. No. 5,295,433.

SUMMARY OF THE INVENTION

It is an object of the invention to provide an improved security mechanism for the value selection means of a postage meter, the improved security mechanism having increased sensitivity in response to forces exerted on the print wheel tending to disassociate the print wheel from its drive train.

Yet another object of the invention is to provide means for preventing disassociation of the, rack gear and associated print wheel.

Still other objects of the invention are to provide means for weakening the drive train of a value setting mechanism, against a force exerted against the print wheel tending to separate the print wheel from the drive train, and to provide means responsive to the force exerted for jamming the value setting mechanism.

Another object of the invention is to provide a security mechanism which can easily be retrofit into existing print wheel rack designs utilizing existing tooling.

The above objects are met by providing a value selection and printing apparatus including a printing device having a printing wheel which is rotatable into a plurality of positions to present a corresponding plurality of value printing elements into a printing position; a value selecting device including a moveable first rack gear having a driven element thereon, a rigid guide shaft mounted within the printing device, a second rack gear being mounted to be slidable on the guide shaft and having a driving element thereon in engagement with the driven element, wherein the second rack gear operatively engages the printing wheel so that rotation of the printing wheel occurs due to transmission of a movement of the first rack gear to the printing wheel via the second rack gear; and a substantially cylindrical security sleeve slideable disposed on the guide shaft and moveable in response to sliding movement of the second rack gear on the guide shaft; wherein the guide shaft includes a weakened section such that at times when a force sufficient to disassociate the printing wheel and the second rack gear is exerted against the printing wheel, the guide shaft bends at the weakened section preventing sliding movement of the security sleeve over the weakened section.

Additional objects and advantages of the invention will be set forth in the description which follows, and in part will be obvious from the description, or may be learned by practice of the invention. The objects and advantages of the invention may be realized and obtained by means of the instrumentalities arid combinations particularly pointed out in the appended claims.

Figure 1:
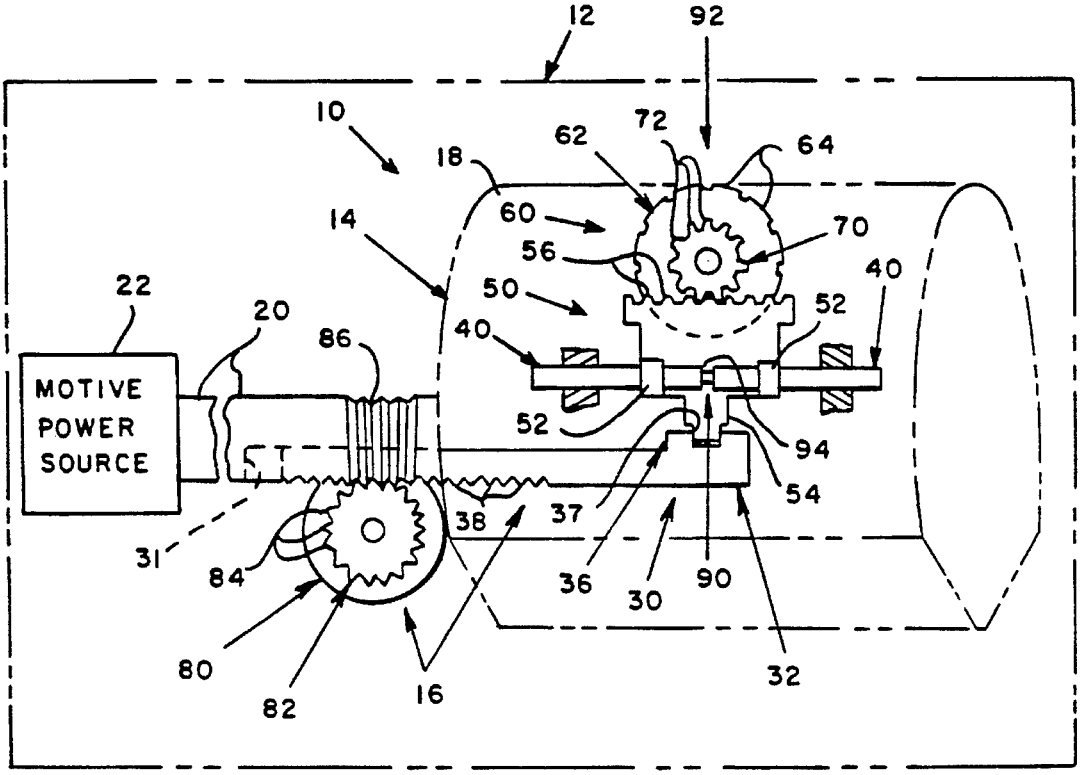
FIG. 1 (PRIOR ART)
FIG. 1 is a schematic view of a conventional rotary postage printing device, or equivalent structure, represented by a drum and a drive shaft therefor, including a value selection rack gear, print wheel and drive train therebetween, wherein the drive train includes a rack gear slidably mounted on a guide shaft.

The accompanying drawings wherein like reference numerals represent like or corresponding parts throughout the several views are incorporated in and constitute a part of the specification, illustrate a presently preferred embodiment of the invention, and together with the general description given above and the detailed description of the preferred embodiments given below, serve to explain the principles of the invention.

DESCRIPTION OF THE PREFERRED EMBODIMENT

As shown in FIG. 1, a value selection and printing mechanism 10 of the type which is used in a postage meter 12, generally includes value printing structure 14 and postage value selecting structure 16.

The postage value printing structure 14 includes a rotatable printing device or equivalent structure represented by a drum 18, and a drive shaft 20 for the drum 18. In addition, the printing structure 14 includes a conventional source of supply 22 of motive power, such as a conventional single revolution clutch or a conventional electronically controlled d.c. motor, which is suitably connected to the drive shaft 20 for rotation thereof. A more detailed description of the aforesaid typical printing structure 14 may be found in one or more of the aforesaid U.S. Pat. Nos. 4,050,374; 4649,814; 4,630,210, and 3,682,378 or in other U.S. Patents referred to therein.

The postage value selecting structure 16 includes an elongate, first, rack gear 30 which is conventionally slidably movably connected to the drive shaft 20, preferably as by nesting the rack gear 30 within a channel 31 formed in the drive shaft 20. The first rack gear 30 includes a first portion 32 of the longitudinal length thereof which is longitudinally movable internally of the printing drum 18, and a second portion 34 of the longitudinal length thereof, which is longitudinally movable externally of the drum 18. The internally movable portion 32 includes a driven element 36, which is preferably an element forming an aperture 37, such as a slot in the internally movable portion 32. The externally movable portion 34 including a plurality of first gear teeth 38 formed therein longitudinally of the length thereof. The postage value selecting structure 16 additionally includes a rigid, guide, shaft 40, which is conventionally fixedly mounted within the printing drum 18. Moreover, the postage value selecting structure 16 includes an elongate second rack gear 50, which is conventionally slidably movably connected to the guide shaft 40, preferably, as by mounting the second rack gear in sliding engagement with the guide shaft 40. In this connection, the second rack gear 50 preferably includes a pair of oppositely-spaced, substantially tubularly-shaped, supporting portions 52 thereof, which are aligned axially with one another longitudinally of the length of the second rack gear 50 and slidably mounted on the guide shaft 40 at spaced intervals therealong. The second rack gear 50 includes a driving element 54 thereof, which is preferably a tang portion extending therefrom laterally of the longitudinal length thereof. The first rack gear's driven element 36 and second rack gears driving element 54 are preferably conventionally cooperatively configured for engagement with one another, to permit the transmission of motive power from the first to the second rack gears, 30, 50. As thus constructed and arranged the second rack gear 50 is slidably translated along the guide shaft 40 in response to translation of the first rack gear 30. In addition, the second rack gear 50 includes a plurality of second gear teeth 56 formed therein longitudinally of the length thereof. Moreover, the postage value selecting structure 16 includes a postage value printing wheel 60. The printing wheel 60 includes a circumferentially extending periphery 62, and includes a plurality of printing elements or fonts 64 which are located at spaced intervals about the periphery 62. In the postage value printing environment herein discussed, the printing fonts 64 include, for example, the numerals 1 through 9, and include a numeral zero or graphic symbol, and a blank or period element. The printing elements 64 are respectively movable, in response to rotation of the print wheel 60, to a printing position externally of the postage printing drum 18. Further, the postage value selecting structure 16 preferably includes a pinion gear 70 having a plurality of circumferentially-extending gear teeth 72. The pinion gear 70 is conventionally coaxially, fixedly, attached to the value printing wheel 60 for rotation thereof in response to rotation of the pinion gear 70, and the gear teeth 72 are disposed in meshing engagement with the second rack gear teeth 56 for rotating the print wheel 60 in response to translation of the second rack gear 50 by the first rack gear 30. Still further, for translating the first rack gear 30, the postage value selection structure 16 includes conventional structure 80 for driving the first rack gear 30 including a pinion gear 82 having gear teeth 84 disposed in meshing engagement with the first rack gear teeth 38. Without departing from the spirit and scope of the invention, the driving structure 80 may be a stepper motor, d.c. motor or manually actuatable structure for driving the pinion gear 82, as for example, is set forth in the previously referenced U.S. patents. The drum drive shaft 20 includes a plurality of circumferentially-extending gear-tooth-shaped grooves 86 formed in the outer periphery thereof to permit the drum drive shaft 20 to rotate in engagement with the rack translating pinion gear 82.

Figure 2:
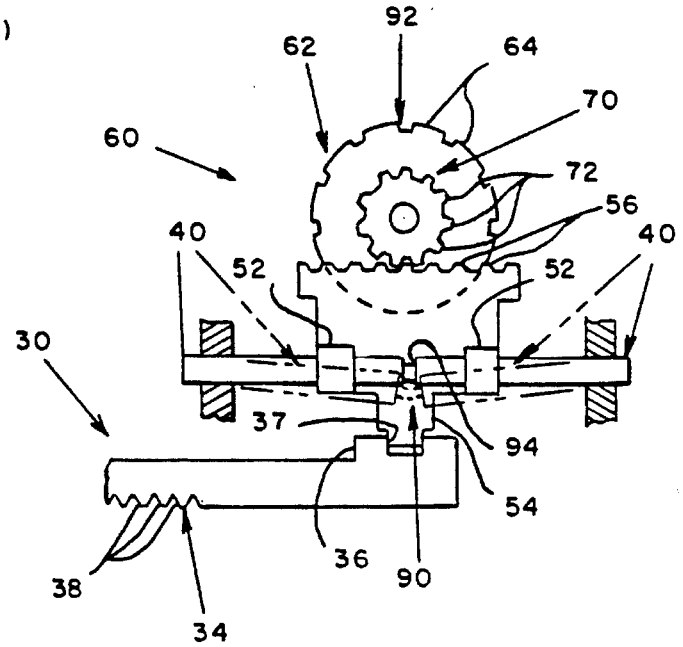
FIG. 2 (PRIOR ART)
FIG. 2 is a side view of the value selection rack gear, print wheel and drive train of FIG. 1, wherein the guide shaft has been weakened to bend in response to a predetermined force applied to the print wheel.

The postage value selection structure 16 (FIGS. 1 and 2) includes structure 90 for weakening the guide shaft 40 against the application of a force 92 exerted against the printing wheel 60 which is sufficient to disassociate the printing wheel 60 from the second rack gear teeth 56. More particularly, the value selection structure 70 includes at least one circumferentially-extending channel 94 formed in the guide shaft 40 for weakening the rigidity of the guide shaft 40 against the application of force 92 to permit the guide shaft 40 to bend, as illustrated by the dashed-line presentation of the guide shaft 40 in FIG. 2, in response to the force 92, whereby the second rack gear 50 will become jammed against slidable movement thereof on the guide shaft 40. That is, the supporting portions 52 of the second gear rack 50 will not be able to slide along the bent guide shaft 40, but will jam against the guide shaft 40 when the printing wheel 60 is attempted to be moved.

While the above described device of U.S. Pat. No. 5,295,433 is generally effective, more precise security sensitivity is desirable. That is, during the manufacturing of the sheet metal rack 50, it is very difficult to control the internal dimensions of the cylindrical supporting portions 52 within precise tolerances. The dimensional difference between the internal circumferential dimension of the supporting portions 52 and the external circumferential dimension of the guide shaft 40 will impact the sensitivity of the security mechanism. That is, the more "close fitting" the supporting positions 52 are to the outer circumference of the guide shaft 40, the easier it will be for the supporting portions 52 to jam upon bending of the guide shaft 40. Put in another way, the security mechanism will tend to jam with less bending of the guide shaft 40 required with smaller tolerances permitted between the internal circumferential dimension of the supporting portions 52 and the outer circumferential dimension of guide shaft 40. However, as previously discussed, the forming of the supporting portion dimensions cannot be precisely controlled such that the sensitivity of individual apparatus can vary significantly.

Figure 3:
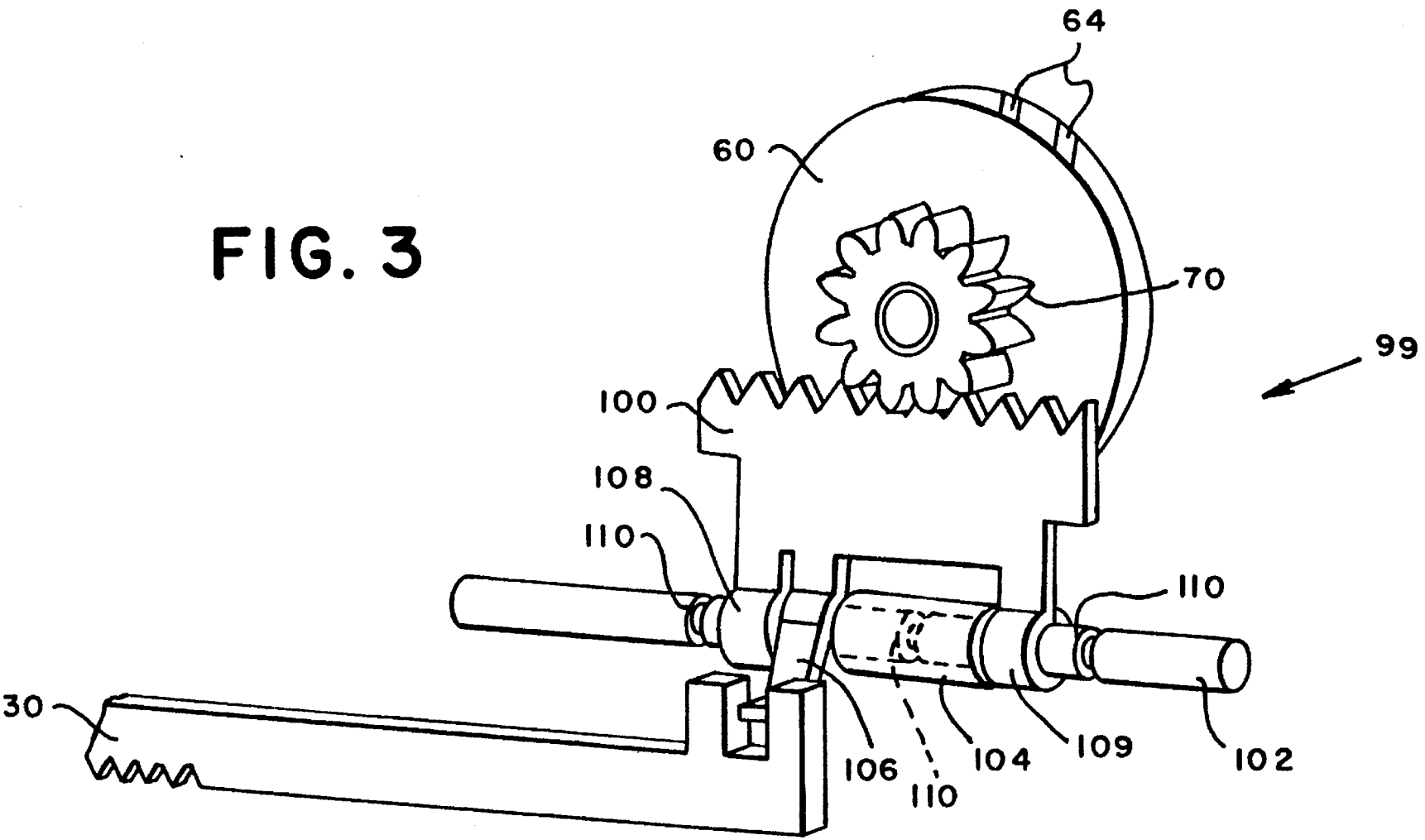
FIG. 3 is a side view of the inventive value selection rack gear, print wheel, and drive train arrangement including a weakened guide shaft and a security sleeve.

FIG. 3 is a side view of a security mechanism 99 including a value selection rack gear 100, print wheel 60, pinion gear 70, guide shaft 102, first rack gear 30 and security sleeve 104 according to the invention, which can be used in lieu of the second rack gear 50, guide rod 40, print wheel 60, pinion gear 70 and first rack gear 30 of FIG. 1. The operating interrelationship between rack gear 100, pinion gear 70, print wheel 60, and first rack gear 30 are the same as the corresponding structure of FIG. 1. However, the value selection rack gear 100 differs from the second rack gear 50 of FIG. 1 in that the driving element 106 is centrally offset to permit the placement of security sleeve 104 around guide rod 102 between supporting portions 108, 109 of value selection rack gear 100. As the value selection rack gear 100 moves along the guide rod 102, the captured security sleeve 104 moves therewith. It is to be noted that the specific arrangement shown of the driving element 106 and security sleeve 104 can be varied as long as the security sleeve 104 is captured by and moves with the value selection rack gear 100.

The importance of providing the security sleeve 104 is to create a more sensitive security mechanism. The security sleeve 104 is a separate component from the rack gear 100 such that its internal cylindrical dimension can be more closely controlled during manufacture, as compared to the internal cylindrical dimensions of the supporting portions (52, 106, 108). Therefore, security sleeve 104 can more assuredly closely fit around the outer circumference of the guide rod 102. Due to the tighter dimensional tolerances of the security sleeve 104, it is more sensitive to bending of the guide rod 102. That is, a smaller deflection of the guide rod 102 is required, as compared to the prior art structure of FIG. 1, in order to insure that the security sleeve 104 will be jammed into the guide rod 102, thereby preventing movement of value selection rack gear 100. Additionally, since the length of the security sleeve 104 is longer than the length of the supporting positions (52, 106,108) it is much more susceptible to jamming for a given small deflection of the guide rod 102. As used in the above context, the inventive apparatus is more sensitive than prior art devices in that it jams at a lower amount of bending of the guide rod and/or a larger force would be required to move the sleeve 104 through the distorted (bent) section of the guide rod (as compared to, for example, a force required to move second gear rack 50 along the guide rod 40 over a same distorted (bent) section).

In addition to the security sleeve 104, the invention is more sensitive to bending of the guide rod 102 due to the inclusion therein of a plurality of circumferentially extending channels 110. That is, by including a plurality of channels 110, the guide rod 102 will distort with the value selection rack gear 100 positioned anywhere along the guide rod 104 when the printing wheel 60 is subjected to a force sufficient to separate the printing wheel 60 from the drive train.

It is noted that in a typical postage meter a plurality of printing wheel 60 from the drive train used and thus a plurality of security mechanisms can be included to have a one to one correlation with a respective printing wheel. Moreover, while the preferred form of the security sleeve is shown in FIG. 3 as being cylindrical on its inner and outer surfaces, variations of this configuration are possible. For example, the outer shape of the security sleeve could be differently shaped while having a cylindrical bore therein through which the guide shaft passes. Moreover, the inner surface of security sleeve 104 could, for example, be a plurality of planar surfaces which form a substantially cylindrical shape.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A value selection and printing apparatus comprising:

a printing device including a printing wheel which is rotatable into a plurality of positions to present a corresponding plurality of value printing elements into a printing position;

a value selecting device including a moveable first rack gear having a driven element thereon, a rigid guide shaft mounted within the printing device, a second rack gear mounted on said guide shaft and slidable along said guide shaft, and having a driving element thereon in engagement with said driven element, said second rack gear engaging said printing wheel so that rotation of said printing wheel occurs due to transmission of a movement of said first rack gear to said printing wheel via said second rack gear; and a substantially cylindrical security sleeve disposed to be slidable on said guide shaft and moveable in response to sliding movement of said second rack gear on said guide shaft;

wherein said guide shaft includes a weakened section, said weakened section being a means to disassociate said printing wheel and said second rack gear when a sufficient force is exerted against said printing wheel to bend at said weakened section and thereby prevent sliding movement of said security sleeve over said weakened section.

2. A value selection and printing apparatus as recited in claim 1, wherein said guide rod includes a plurality of weakened sections spaced along said guide rod.

3. A value selection and printing apparatus as recited in claim 1, wherein said weakened section includes an annularly-extending channel formed in said guide shaft.

4. A value selection and printing apparatus as recited in claim 1, wherein said second rack gear includes oppositely spaced portions slidably mounted on said guide shaft and said security sleeve is captured between said oppositely spaced portions to captively move with said second rack gear along said guide shaft.

5. A value selection and printing apparatus as recited in claim 4, wherein said weakened section includes an annularly-extending channel formed in said guide shaft.

6. A value selection and printing apparatus according to claim 5, wherein said oppositely spaced portions each include a substantially cylindrical bore, said security sleeve includes a substantially cylindrical opening, said guide shaft passes through said cylindrical bore and said cylindrical opening, and a circumferential dimension of the cylindrical opening is closer in value to a circumferential outer dimension of non-weakened sections of said guide shaft than said circumferential dimension of said cylindrical bores is to said circumferential outer dimension of said non-weakened sections of said guide shaft.

7. A value selection and printing apparatus according to claim 4, wherein a length of said security sleeve is longer than the length of said oppositely spaced portions.

8. A value selection and printing apparatus comprising:

means for printing a value, including a rotatable device and a drive shaft therefor;

means for selecting the value, including a first rack gear slidably movably connected to the drive shaft, the first rack gear including a first portion moving internally of the rotatable device and a second portion moving externally of the rotatable device, the first portion including a driven element, the externally movable portion including a plurality of first gear teeth formed therein;

the means for selecting a value including a rigid guide shaft fixedly mounted internally of the apparatus and an elongate second rack gear slidably connected to the guide shaft for movement therealong, the second rack gear including a driving, element therefor, the driven element and the driving element disposed in engagement, the second rack gear including a plurality of second gear teeth;

the value selecting means including a value printing wheel, the printing wheel including a circumferentially-extending periphery and a plurality of printing elements located at space intervals thereabout, the value selecting means; including a pinion gear coaxially fixedly attached to the printing wheel for rotation thereof, the pinion gear disposed in meshing engagement with the second rack gear teeth for rotation of the pinion gear and thus the print wheel in response to movement of the second rack gear;

means for weakening the rigidity of the guide shaft against a force exerted against the printing wheel which is sufficient to disassociate the printing wheel and the second rack gear to permit the guide shaft to bend in response to the force, and a cylindrical security sleeve slidably disposed on said guide shaft and captured by said second rack gear to move therewith along said guide shaft, whereby at times when said force is exerted on said printing wheel said weakening means prevents movement of said security sleeve past said weakening means.

9. The apparatus according to claim 8, wherein the second rack gear includes oppositely spaced portions thereof slidably connected to the guide shaft at spaced intervals therealong and said security sleeve is captured between said oppositely spaced portions.

10. The apparatus according to claim 9, wherein the weakening means includes at least one annularly-extending channel formed in the guide shaft.

11. The apparatus according to claim 10, wherein the weakening means includes a single annularly-extending channel formed in the guide shaft.

12. The apparatus according to claim 8, wherein one of the driving and driven elements includes a tang portion of one of the first and second rack gears and the other of the driving and driven elements includes an aperture of the other of the first and second rack gears.

13. The apparatus according to claim 12, wherein the weakening means includes an annularly-extending channel formed in the guide shaft.

14. An apparatus according to claim 8, wherein said weakening means includes a plurality of spaced weakened sections formed in said guide shaft.

15. The apparatus according to claim 8, wherein the weakening means includes an annularly-extending channel formed in the guide shaft.

* * * * *